US006968672B2

(12) United States Patent
Tiemann

(10) Patent No.: US 6,968,672 B2
(45) Date of Patent: Nov. 29, 2005

(54) COLLAR FOR A COMBUSTION CHAMBER OF A GAS TURBINE ENGINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/488,622

(22) PCT Filed: Aug. 27, 2002

(86) PCT No.: PCT/EP02/09556

§ 371 (c)(1),
(2), (4) Date: Mar. 2, 2004

(87) PCT Pub. No.: WO03/021149

PCT Pub. Date: Mar. 13, 2003

(65) Prior Publication Data

US 2004/0237500 A1 Dec. 2, 2004

(30) Foreign Application Priority Data

Sep. 3, 2001 (EP) ..... 01121089

(51) Int. Cl.[7] ..... F02C 3/00
(52) U.S. Cl. ..... 60/39.37; 60/752; 60/805
(58) Field of Search ..... 60/796, 797, 798, 60/799, 800, 801, 804, 770, 39.37, 752–755, 60/757, 758, 805

(56) References Cited

U.S. PATENT DOCUMENTS 3,169,367 A * 2/1965 Hussey ..... 60/39.37
3,840,332 A * 10/1974 Smith ..... 431/351
3,990,837 A * 11/1976 Snell ..... 60/752
4,008,568 A * 2/1977 Spears ..... 60/796
4,297,842 A 11/1981 Gerhold et al.
4,704,869 A 11/1987 Iizuka et al.
4,719,748 A 1/1988 Davis, Jr. et al.
4,794,753 A 1/1989 Beebe
5,323,600 A 6/1994 Munshi
5,398,509 A * 3/1995 North et al. ..... 60/755
5,499,499 A * 3/1996 Ambrogi et al. ..... 60/800
5,737,913 A * 4/1998 Terry ..... 60/796
6,098,397 A * 8/2000 Glezer et al. ..... 60/772
6,134,877 A * 10/2000 Alkabie ..... 60/800
6,173,561 B1 * 1/2001 Sato et al. ..... 60/772
6,182,451 B1 * 2/2001 Hadder ..... 60/732
6,216,442 B1 * 4/2001 Belsom et al. ..... 60/797
6,354,071 B2 * 3/2002 Tegel et al. ..... 60/772

* cited by examiner

*Primary Examiner*—William H. Rodriguez

(57) ABSTRACT

This invention relates to a combustion chamber arrangement for a gas turbine, with a number of individual combustion chambers which open into an annular gap, leading to a turbine chamber, whereby burners are arranged before the individual combustion chambers, connected to the individual combustion chambers through a turbine housing. According to the invention, said combustion chamber arrangement may be further developed, such that the cooling efficiency of the individual combustion chambers may be significantly improved, with an embodiment of simple construction, whereby at least one collar, arranged on one side of the turbine housing, facing the turbine chamber, running radially in the direction of the turbine chamber, at least partly surrounds a section of at least one individual combustion chamber whilst leaving a gap space.

14 Claims, 2 Drawing Sheets

COLLAR FOR A COMBUSTION CHAMBER OF A GAS TURBINE ENGINE

CROSS REFERENCE TO RELATED APPLICATIONS

This application is the US National Stage of International Application No. PCT/EP02/09556, filed Aug. 27, 2002 and claims the benefit thereof. The International Application claims the benefits of European application No. 01121089.5 EP filed Sep. 3, 2001, both of the applications are incorporated by reference herein in their entirety.

FIELD OF INVENTION

The invention relates to a combustion chamber arrangement for a gas turbine with a plurality of individual combustion chambers which open into a common annular gap leading to a turbine chamber, whereby burners are arranged ahead of the individual combustion chambers, said burners being connected to the individual combustion chambers through an outer housing. The invention also relates to a gas turbine with such a combustion chamber arrangement.

BACKGROUND OF INVENTION

Combustion chamber arrangements of this kind for gas turbines are known in the prior art. A mixture of an oxygenous fuel gas and a propellant is ignited in the burners and combusted in the combustion chambers and the expanding hot gases are deflected by the transition sections of the individual combustion chambers toward the turbine chamber and the arrangement of vanes and blades located therein. The streams of hot gas with a circular cross-section generated in the typically cylindrical inlet sections of the individual combustion chambers are thereby transformed by the transition sections into a hot gas stream with a ring-segment-shaped cross-section and finally combined into a circular hot gas stream. This passes through the annular gap into the turbine chamber and drives the blades of the gas turbine.

The heat released during combustion of the fuel gas/propellant mixture causes the individual combustion chambers to be heated to a significant degree, which means that intensive cooling is required in this area. Various cooling principles are proposed for this in the prior art. With a combustion chamber arrangement shown in U.S. Pat. No. 4,719,748 the entire individual combustion chamber is designed with a twin-layer housing, whereby an air gap is left between the individual housing layers. A cooling fluid flows in through openings in the outer housing layer into the intermediate space left between the housing layers and impinges on the inner layer of the individual combustion chamber. This already results in a first cooling effect which is referred to as impingement cooling. The cooling fluid subsequently flows through the intermediate space left between the housing layers and provides convective cooling. This design is also referred to as a closed cooling system on account of the continuous twin-layer configuration of the combustion chamber walls.

Another concept is referred to as open cooling, whereby the individual combustion chambers are configured with a single wall. Cooling fluid flows openly past the individual combustion chambers and has a cooling effect. Because the individual combustion chambers are configured with a single wall, the flow of cooling fluid is not conveyed in a directed and defined manner, resulting in a generally lower level of cooling efficiency. On the other hand such a configuration of the individual combustion chambers is simpler in construction and more economical to manufacture.

From the more recent prior art it is also known that hybrid forms of open and closed cooling systems can be used for the individual combustion chambers. Large areas of the individual combustions chambers are then subject to open cooling, while an area to be cooled by a closed cooling system is created by means of an arrangement of a second wall surrounding the first wall and leaving an intermediate space solely in an area projecting through an outer housing. With this design the individual combustion chambers used are configured with a simple construction as before but the improved cooling effect achieved with a very small area cooled in a quasi-closed manner is not as significant as might be wished.

SUMMARY OF INVENTION

Based on this prior art, the object of the invention is to develop further a combustion chamber arrangement of the type referred to above so that cooling efficiency can be significantly improved with combustion chambers designed with a simple structure.

To achieve this object it is proposed that with a combustion chamber arrangement of the kind referred to above at least one collar disposed on a side of the turbine outer housing, facing the turbine chamber, running radially in the direction of the turbine chamber, at least partly encloses a section of at least one combustion chamber, while leaving a gap space.

The at least one collar running radially in the direction of the turbine chamber and disposed on the turbine housing encloses a section located within the turbine outer housing of at least one individual combustion chamber and leaves a gap space between the wall of the individual combustion chamber and the collar. A cooling fluid can flow into this gap space and bring about more effective convective cooling in this area due to the defined flow channel. The structure of the individual combustion chambers themselves still remains simple in this design; there is no need to complicate the construction of the individual combustion chambers per se. In this way the area of the individual combustion chamber cooled in a quasi-closed manner is extended into the inside of the turbine outer housing in the direction of the turbine chamber and cooling efficiency is noticeably improved.

In order to enlarge the area with quasi-closed cooling still further it is proposed according to the invention that at least one tongue-like extension be configured on the collar, running along a flattened side of the transition section of the individual combustion chamber, said side being tangential in relation to the annular gap, leaving an intermediate space in respect of this.

The arrangement of a tongue of this kind means that the cooling fluid used for cooling purposes is directed into a defined space even earlier and can contribute more effectively to convective cooling of the individual combustion chamber. In order to create an adequate inflow area into the intermediate space here it is advantageous if the tongue-like extension formed on the collar tapers in the direction of the annular gap or the turbine chamber.

In order to extend the collar provided according to the invention as far as possible in the direction of the turbine chamber, according to an advantageous development of the invention it is proposed that the collar should have recesses at the point where it abuts against a collar for an adjacent individual combustion chamber, said recesses forming an essentially leak-tight transition to corresponding recesses in the adjacent collar.

According to an advantageous development of the invention, in this case the collar can be configured in a closed manner in the circumferential direction of the individual combustion chamber such that the cooling system is quasi-closed over the entire circumferential area of the individual combustion chamber in the section in which the collar according to the invention projects into the outer housing of the gas turbine.

According to a development of the invention the individual combustion chamber comprises an essentially cylindrical inlet section arranged after the burner and a transition section merging into a circular sector, whereby the collar partially encloses at least the inlet section. Because of its proximity to the burner the inlet section is an element of the individual combustion chamber that is subject to a particularly high thermal load, with the result that the possibility of quasi-closed cooling offered in this area due to the collar provided according to the invention represents a significant improvement to the cooling of the individual combustion chamber with a comparatively low outlay in respect of cooling fluid. A low outlay in respect of cooling fluid increases the economic viability of the gas turbine overall and, in cases where the cooling fluid is used at the same time as a fuel gas, the efficiency of the gas turbine is also increased. With a cylindrical design of the inlet section, according to a development of the invention the collar has a circular cross-sectional area and is arranged concentrically around the cylindrically designed inlet section. This results in a uniform gap space in the circumferential direction of the inlet section, allowing uniform distribution of the cooling fluid stream and therefore uniform cooling in this area.

A gas turbine with a combustion chamber arrangement according to the above embodiments is equally the object of the invention.

BRIEF DESCRIPTION OF THE DRAWINGS

Further advantages and features of the invention will emerge from the exemplary embodiments described below with reference to the attached drawings, in which.

The same elements are identified by the same reference characters in the figures.

DETAILED DESCRIPTION OF INVENTION

Figure 1:
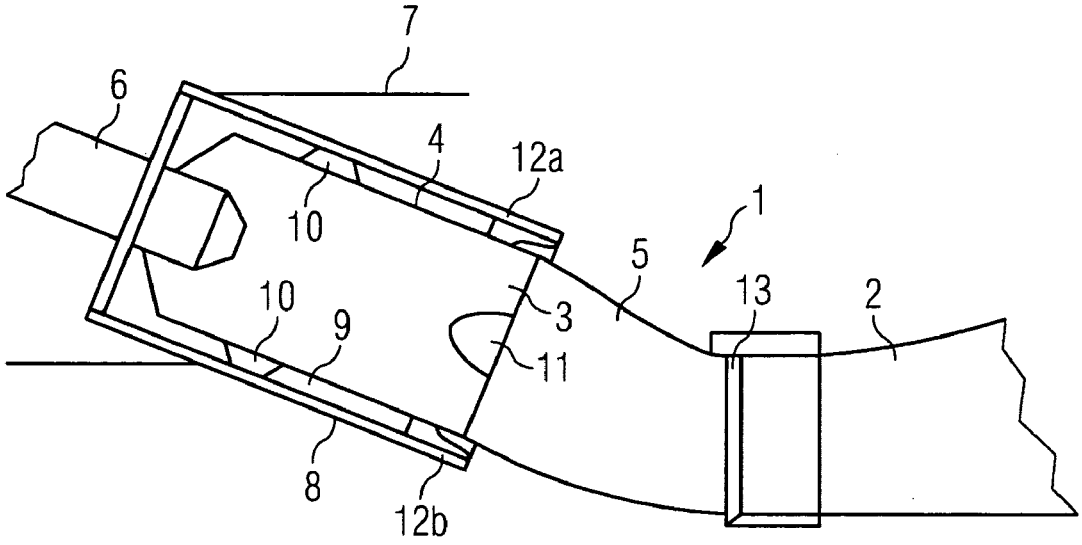
FIG. 1 shows a cross-sectional view of a section of a gas turbine with a combustion chamber arrangement according to the invention.

FIG. 1 shows a cross-sectional view of a section from a gas turbine with a combustion chamber arrangement 1 according to the invention. The combustion chamber arrangement 1 comprises a plurality of individual combustion chambers 3, which are arranged in an overlapping ring shape and open into a common annular gap 13. The annular gap 13 in turn opens into a turbine chamber 2 in which schematically indicated vanes and blades of the turbine are located.

Burners 6 are arranged ahead of each of the individual combustion chambers 3. These are used to ignite a mixture comprising an oxygenous fuel gas and a propellant, said mixture continuing to burn in the individual combustion chambers 3. The individual combustion chambers 3 thereby comprise an inlet section 4 attached to the burner 6 and a transition section 5 transitioning the inlet section 4 in the direction of the annular gap 13. The burners 6 are connected to the individual combustion chambers 3 through a turbine outer housing 7. Proceeding outward from the turbine outer housing 7 in the direction of the turbine chamber 2 it is possible to recognize a collar 8 which runs concentrically around the cylindrically designed inlet section 4 of the individual combustion chamber 3. Between the collar 8 and the inlet section 4 of the individual combustion chamber 3 there is left a gap space 9 through which a cooling fluid can flow. Ribs 10 are formed on the inlet section 4 of the individual combustion chamber 3 and distributed along the circumference and the individual combustion chamber 3 abuts via these against the collar 8. In the exemplary embodiment shown the ribs 10 are formed on the individual combustion chamber 3 but they can also be formed on the collar 8 and run in the direction of the individual combustion chamber 3.

At the side of the collar 8 can be seen a recess 11 to which an adjacent collar of a neighboring individual combustion chamber is attached. In order to combine the individual combustion chambers 3 into a common annular gap 13, each of the individual combustion chambers is arranged at an angle to the others. This means that the distance between the individual combustion chambers decreases proceeding from the burner 6 toward the annular gap 13, so that the cylindrical collars 8 abut each other from a certain distance in the direction of the annular gap 13. The recesses 11 are arranged at this point so that the collars 8 can be extended still further inward in the direction of the annular gap 13. Adjacent collars 8 are in contact with each other along the edges of the recesses 11 and can be connected together, for example by welding, for sealing purposes.

The collars 8 arranged according to the invention together with their gap space 9 form a flow channel for a cooling fluid. Because of the defined flow channel, the cooling fluid conveyed in a quasi-closed manner in the flow channel effectively contributes to the convective cooling of the individual combustion chambers 3 in the area covered by the collars 8.

FIG. 1 also shows two tongue-like extensions 12*a* and 12*b* opposite each other and running tangentially in respect of the annular gap 13, said extensions being guided along the transition section 5 of the individual combustion chamber 3 and leaving a gap space. These tongue-like extensions 12*a* and 12*b* represent an advantageous development of the invention but are optional. They result in a further enlargement of the area of the individual combustion chamber 3 cooled by means of a quasi-closed system and thereby to a further improvement in cooling efficiency. A basic version of a combustion chamber arrangement according to the invention can however be achieved without the tongue-like extensions 12*a* and 12*b* and just with the collars 8.

Figure 2:
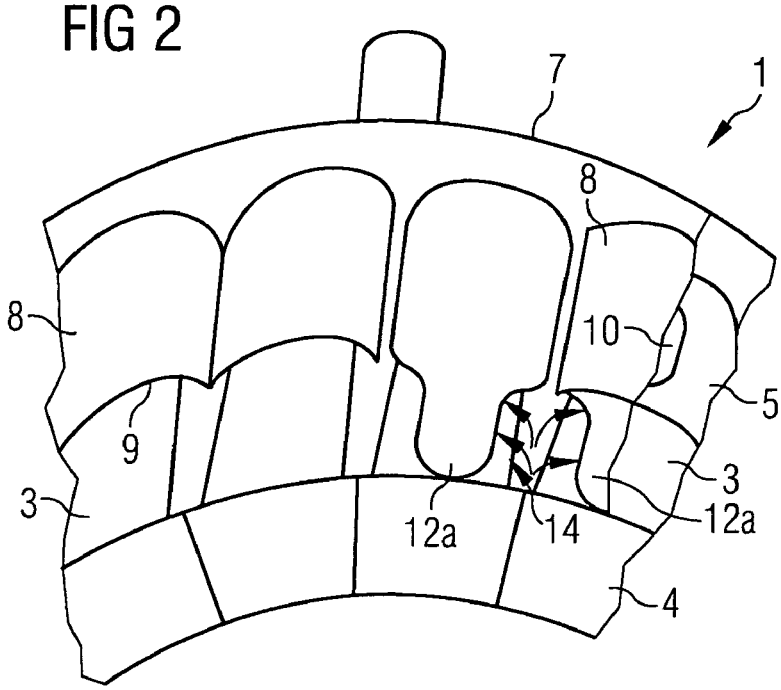
FIG. 2 shows a perspective view of a section from a combustion chamber arrangement according to the invention seen from the direction of the turbine chamber, whereby some of the collars according to the invention shown have tongue-like extensions according to an alternative exemplary embodiment.
Figure 3:
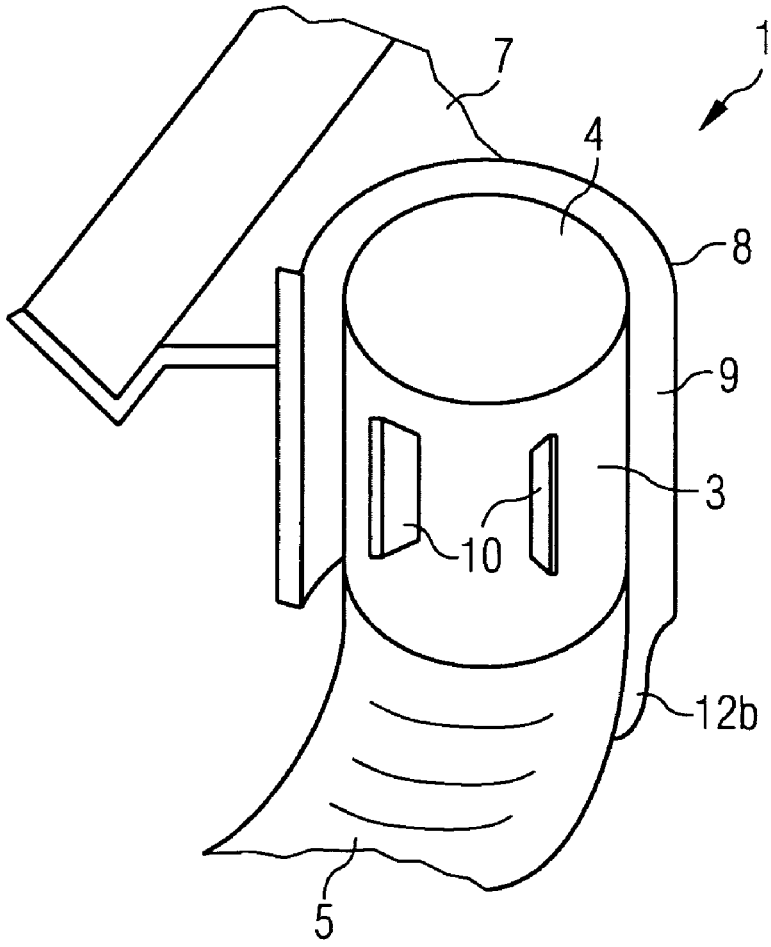
FIG. 3 shows a perspective view of a section from a combustion chamber according to the invention, seen from the direction of the burner, whereby some of the collars according to the invention shown are configured with tongue-like extensions.

FIGS. 2 and 3 show a perspective view from different directions of sections from combustion chamber arrangements configured according to the invention. To clarify the different variants with and without tongue-like extensions

12*a* and 12*b*, only some of the collars 8 surrounding the individual combustion chambers 3 at least in the inlet sections 4 are shown with the tongue-like extension 12*a* or 12*b*. FIG. 2 also has arrows to show the pattern of the flow 14 of a cooling fluid from the area cooled in an open manner toward the gap spaces below the tongue-like extensions 12*a* and then below the collars 8. It can also be seen that the tongue-like extensions 12*a* and 12*b* taper toward the outlet transitioning into the gap space from the transition sections 5 of the individual combustion chambers 3. This ensures a sufficiently large entry area for the cooling fluid stream.

It can be seen that with the combustion chamber arrangement 1 according to the invention an area of the individual combustion chambers cooled by a quasi-closed system is created, in which the individual combustion chambers can be cooled with a high level of efficiency. The individual combustion chambers are also of simple construction and an expensive twin-wall design is not required for the individual combustion chambers. With the invention therefore a simple means is specified for creating a simple combustion chamber arrangement with the possibility of highly efficient cooling.

What is claimed is:

1. A combustion chamber arrangement for a gas turbine, comprising:

a plurality of individual combustion chambers that open into a common annular gap transitioning into a turbine chamber;

a plurality of burners arranged ahead of the individual combustion chambers, each burner connected to an individual combustion chamber through a turbine outer housing;

a collar extending in the direction of the turbine chamber arranged on the side of the turbine outer housing toward the turbine chamber and enclosing a section of at least one of the individual combustion chambers and at least partially leaving a gap space and having a lateral recess in an area between two adjacent collars and arranged around adjacent individual combustion chambers, wherein the recesses of the adjacent collars are in contact with each other in an essentially sealing manner; and a tongue-like extension configured on the collar, that projects beyond a flattened side of a transition section and is tangential with respect to the common annular gap and providing a gap.

2. The combustion chamber arrangement according to claim 1, wherein at least one collar is configured in a closed manner in the circumferential direction of the individual combustion chamber.

3. The combustion chamber arrangement according to claim 1, wherein the individual combustion chamber comprises an essentially cylindrical inlet section arranged after the burner and a transition section merging into a ring-sector-shaped cross-section, whereby the collar at least partially encloses at least the inlet section.

4. The combustion chamber arrangement according to claim 3, wherein the inlet section is configured cylindrically and the collar has a circular cross-sectional area and is arranged concentrically around the inlet section.

5. The combustion chamber arrangement according to claim 1, wherein the tongue-like extension is configured to taper toward the annular gap.

6. The combustion chamber arrangement according to claim 1, wherein the adjacent collars are connected together along the edges of the recess.

7. The combustion chamber arrangement according to claim 1, wherein the combustion chamber is arranged in a gas turbine.

8. A turbo-machine combustion chamber, comprising:

a plurality of combustion chambers;

a combustion cylinder surrounding the plurality of combustion chambers;

a collar that surrounds each combustion chamber and having a lateral recess in an area between two adjacent collars and arranged around adjacent individual combustion chambers, wherein the recesses of the adjacent collars are in contact with each other in an essentially sealing manner; and a cooling medium adapted to flow within a gap formed between the combustion chamber and the collar.

9. The combustion chamber as claimed in claim 8, wherein a plurality of individual combustion chambers are arranged circumferentially around a turbine rotor supported by a turbine outer housing to form a combustion chamber arrangement.

10. The combustion chamber claimed in claim 9, wherein the combustion chamber opens into a common annular gap transitioning into a turbine chamber and a burner is arranged upstream of the combustion chamber and is connected to the combustion chamber through an outer housing of the turbine.

11. The combustion chamber as claimed in claim 8, wherein the combustion chamber comprises an essentially cylindrical inlet section arranged downstream of the burner and a transition section merges into a ring-sector-shaped cross-section, and the collar at least partially encloses the inlet section.

12. The combustion chamber as claimed in claim 11, wherein the inlet section is configured cylindrically and the collar has a circular cross-sectional area and is arranged concentrically around the inlet section.

13. The combustion chamber as claimed in claim 8, wherein the combustion chamber arrangement is used in a gas turbine.

14. The combustion chamber as claimed in claim 8, wherein the collar fits completely around the combustion chamber wall.

* * * * *